US009145768B2

(12) United States Patent
Normore et al.

(10) Patent No.: US 9,145,768 B2
(45) Date of Patent: Sep. 29, 2015

(54) METHOD FOR REDUCING STICK-SLIP DURING WELLBORE DRILLING

(75) Inventors: Andrew Derek Normore, Katy, TX (US); Eric E. Maidla, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 182 days.

(21) Appl. No.: 13/541,357

(22) Filed: Jul. 3, 2012

(65) Prior Publication Data

US 2014/0008126 A1 Jan. 9, 2014

(51) Int. Cl.
*E21B 44/04* (2006.01)
*E21B 44/00* (2006.01)

(52) U.S. Cl.
CPC ..... *E21B 44/04* (2013.01); *E21B 44/00* (2013.01)

(58) Field of Classification Search
USPC ..... 175/24, 26, 27, 40, 45, 61
See application file for complete search history.

(56) References Cited

U.S. PATENT DOCUMENTS 6,050,348 A 4/2000 Richarson et al.
6,802,378 B2 * 10/2004 Haci et al. ..... 175/26
6,837,315 B2 1/2005 Pisoni et al.
6,918,453 B2 7/2005 Haci et al.
7,096,979 B2 * 8/2006 Haci et al. ..... 175/61
7,810,584 B2 10/2010 Haci et al.
8,534,354 B2 9/2013 Maidla et al.
2006/0266553 A1 11/2006 Hutchinson

FOREIGN PATENT DOCUMENTS

WO 2012080819 A2 6/2012

OTHER PUBLICATIONS

International Search Report and the Written Opinion for International Application No. PCT/U82013/048408 dated Sep. 16, 2013.

* cited by examiner

*Primary Examiner* — William P Neuder
(74) *Attorney, Agent, or Firm* — Kimberly Ballew; Mark D. Shelley II

(57) ABSTRACT

A method for drilling a wellbore includes operating at least one motor coupled within a drill string to turn a drill bit at an end thereof. An automatic drill string rotation controller causes rotation of the drill string in a first direction until a measured parameter related to torque on the drill string reaches a first selected value. The automatic drill string rotation controller causes rotation of the drill string in a second direction until the measured parameter related to torque is reduced to a second selected value. The drill string is axially advanced to cause the drill bit to extend the wellbore.

20 Claims, 4 Drawing Sheets

48

59
DISPLAY
51 /49 /26
SENSOR MEAS'TS.
PROCESSOR
55
61
DRILL
STRING
ROTATION
CONTROLLER
Torque related
parameter sensor
53
KEYBOARD
57
TO 27 (FIG. 1)

METHOD FOR REDUCING STICK-SLIP DURING WELLBORE DRILLING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to the field of wellbore drilling through subsurface formations. More specifically, the disclosure relates to methods for reducing undesirable modes of motion that induce undesirable vibration levels in a drill pipe "string" used to drill such wellbores.

Drilling wellbores through subsurface includes "rotary" drilling, in which a drilling rig or similar lifting device suspends a drill string which turns a drill bit located at one end of the drill string. Equipment on the rig and/or an hydraulically operated motor disposed in the drill string rotate the bit. The drilling rig includes lifting equipment which suspends the drill string so as to place a selected axial force (weight on bit—"WOB") on the drill bit as the bit is rotated. The combined axial force and bit rotation causes the bit to gouge, scrape and/or crush the rocks, thereby drilling a wellbore through the rocks. Typically a drilling rig includes liquid pumps for forcing a fluid called "drilling mud" through the interior of the drill string. The drilling mud is ultimately discharged through nozzles or water courses in the bit. The mud lifts drill cuttings from the wellbore and carries them to the earth's surface for disposition. Other types of drilling rigs may use compressed air as the fluid for lifting cuttings.

The forces acting on a typical drill string during drilling are very large. The amount of torque necessary to rotate the drill bit may range to several thousand foot pounds. The axial force may range into several tens of thousands of pounds. The length of the drill string, moreover, may be twenty thousand feet or more. Because the typical drill string is composed of threaded pipe segments having diameter on the order of only a few inches, the combination of length of the drill string and the magnitude of the axial and torsional forces acting on the drill string can cause certain movement modes of the drill string within the wellbore which can be destructive. For example, a well known form of destructive drill string movement is known as "stick-slip", in which the drill string becomes rotationally stopped along its length by friction and is caused to "wind up" by continued rotation from the surface. The friction may be overcome and torsional release of the drill string below the stick point may cause such rapid unwinding of the drill string below the stick point so as to do damage to drill string components. Stick slip may be particularly damaging when certain types of directional drilling devices, called "rotary steerable directional drilling systems" are used. Stick-slip may cause undesirable vibrations that in turn could reduce the life of the drill string components such as bits, motors, MWD equipment, LWD equipment and the BHA.

There is a need for methods to reduce destructive modes of motion of a drill string during drilling. There is also a need for methods to reduce fatigue and wear of drill string and wellbore components during drilling.

SUMMARY

A method for drilling a wellbore according to one aspect includes operating at least one motor coupled within a drill string to turn a drill bit at an end thereof. An automatic drill string rotation controller causes rotation of the drill string in a first direction until a measured parameter related to torque on the drill string reaches a first selected value. The automatic drill string rotation controller causes rotation of the drill string in a second direction until the measured parameter related to torque is reduced to a second selected value. The drill string is axially advanced to cause the drill bit to extend the wellbore.

Other aspects and advantages will be apparent from the description and claims which follow.

DETAILED DESCRIPTION

Figure 1:
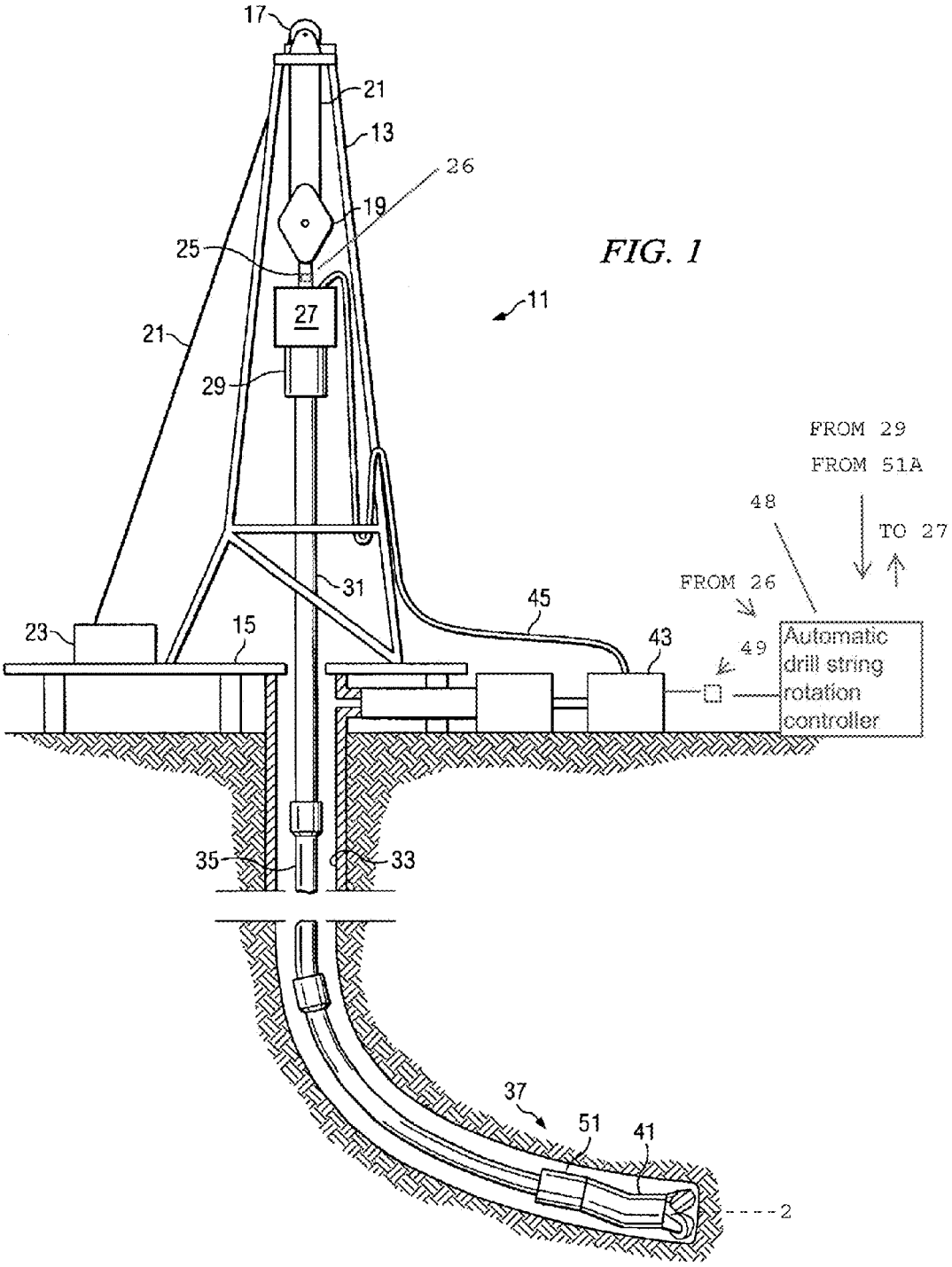
FIG. 1 is a pictorial view of a wellbore drilling system.

In FIG. 1, a drilling rig is designated generally at 11. The drilling rig 11 in FIG. 1 is shown as a land-based rig. However, as will be apparent to those skilled in the art, the examples described herein will find equal application on marine drilling rigs, such as jack-up rigs, semisubmersibles, drill ships, and the like.

The rig 11 includes a derrick 13 that is supported on the ground above a rig floor 15. The rig 11 includes lifting gear, which includes a crown block 17 mounted to derrick 13 and a traveling block 19. Crown block 17 and traveling block 19 are interconnected by a cable 21 that is driven by draw works 23 to control the upward and downward movement of the traveling block 19. Traveling block 19 carries a hook 25 from which is suspended a top drive 27. The top drive 27 supports a drill string, designated generally by the numeral 31, in a wellbore 33. According to an example implementation, a drill string 31 is coupled to the top drive 27 through an instrumented sub 29. As will be described in more detail, the instrumented top sub 29 may include sensors (not shown separately) that provide drill string torque information. A longitudinal end of the drill string 31 includes a drill bit 2 mounted thereon to drill the formations to extend (drill) the wellbore 33.

The top drive 27 can be operated to rotate the drill string 31 in either direction, as will be further explained. A load sensor 26 may be coupled to the hook 25 in order to measure the weight load on the hook 25. Such weight load may be related to the weight of the drill string 31, friction between the drill string 31 and the wellbore 33 wall and an amount of the weight of the drill string 31 that is applied to the drill bit 2 to drill the formations to extend the wellbore 33.

The drill string 31 may include a plurality of interconnected sections of drill pipe 35 a bottom hole assembly (BHA) 37, which may include stabilizers, drill collars, and a suite of measurement while drilling (MWD) and or logging while drilling (LWD) instruments, shown generally at 51.

A drilling motor 41 may be connected proximate the bottom of BHA 37. The motor 41 may be any type known in the art for rotating the drill bit 2 and/or selected portions of the drill string 31. Example types of drilling motors include, without limitation, positive displacement fluid operated motors, turbine fluid operated motors, electric motors and hydraulic fluid operated motors. The present example motor 41 may be operated by drilling fluid flow. Drilling fluid is delivered to the drill string 31 by mud pumps 43 through a mud hose 45. In some examples, pressure of the mud may be measured by a pressure sensor 49. During drilling, the drill string 31 is rotated within the wellbore 33 by the top drive 27, in a manner to be explained further below. As is known in the art, the top drive 27 is slidingly mounted on parallel vertically extending rails (not shown) to resist rotation as torque is applied to the drill string 31. The manner of rotation of the drill string 31 during drilling will be further explained below. During drilling, the bit 2 may be rotated by the motor 41, which in the present example may be operated by the flow of drilling fluid supplied by the mud pumps 43. Although a top drive rig is illustrated, those skilled in the art will recognize that the present example may also be used in connection with systems in which a rotary table and kelly are used to apply torque to the drill string 31. Drill cuttings produced as the bit 2 drills into the subsurface formations to extend the wellbore 33 are carried out of the wellbore 33 by the drilling mud as it passes through nozzles, jets or courses (none shown) in the drill bit 2.

Signals from the pressure sensor 49, the hookload sensor 26, the instrumented tob sub 29 and from the MWD/LWD system 51 (which may be communicated using any known wellbore to surface communication system), may be received in automatic drill string rotation controller 48, which will be further explained with reference to FIG. 2.

Figure 3:
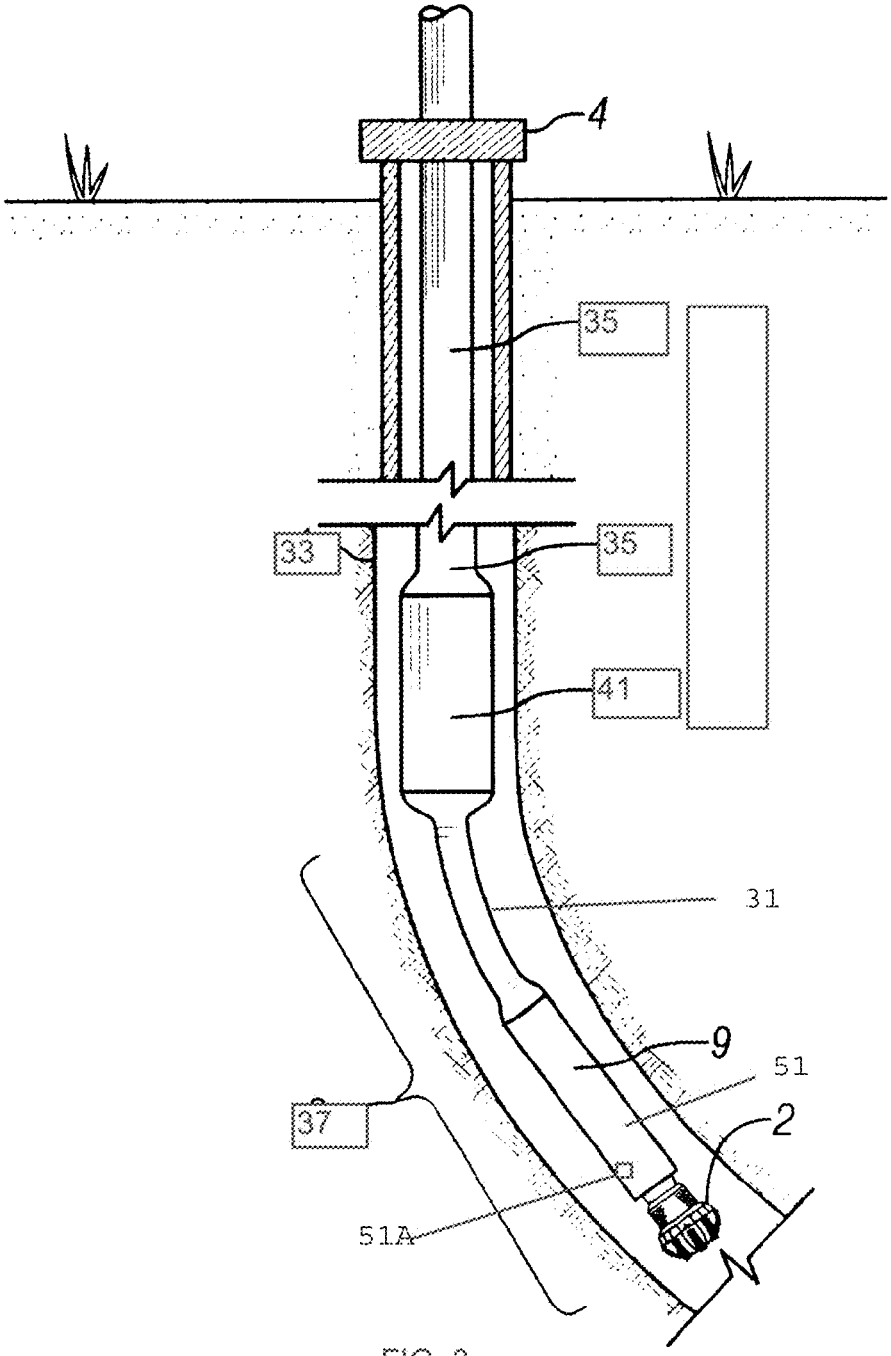
FIG. 3 shows a drill string using a rotary steerable directional drilling system.

In some examples, a trajectory of the wellbore 33 may be selectively controlled (i.e., the wellbore may be drilled along a selected geodetic trajectory) using a "rotary steerable directional drilling system" (RSS). One example of RSS is described in U.S. Pat. No. 6,837,315 issued to Pisoni et al. and incorporated herein by reference. A drill string 31 having a RSS is shown schematically in FIG. 3 at 9. The drill string 31 may also include a motor 41 substantially as explained with reference to FIG. 1, as well as instrumentation 51 corresponding to any or all of the sensors of the MWD/LWD system explained with reference to FIG. 1. In FIG. 3, a kelly 4 is shown for rotating the drill string 31 as explained above. Components of the rig explained with reference to FIG. 1 are omitted for clarity of the illustration. The RSS 9 may include directional sensors, and at least one accelerometer 51A or other sensor responsive to shock and/or vibration. An accelerometer may also be one of the sensors included in the MWD/LWD instrumentation (51 in FIG. 1).

Figure 2:
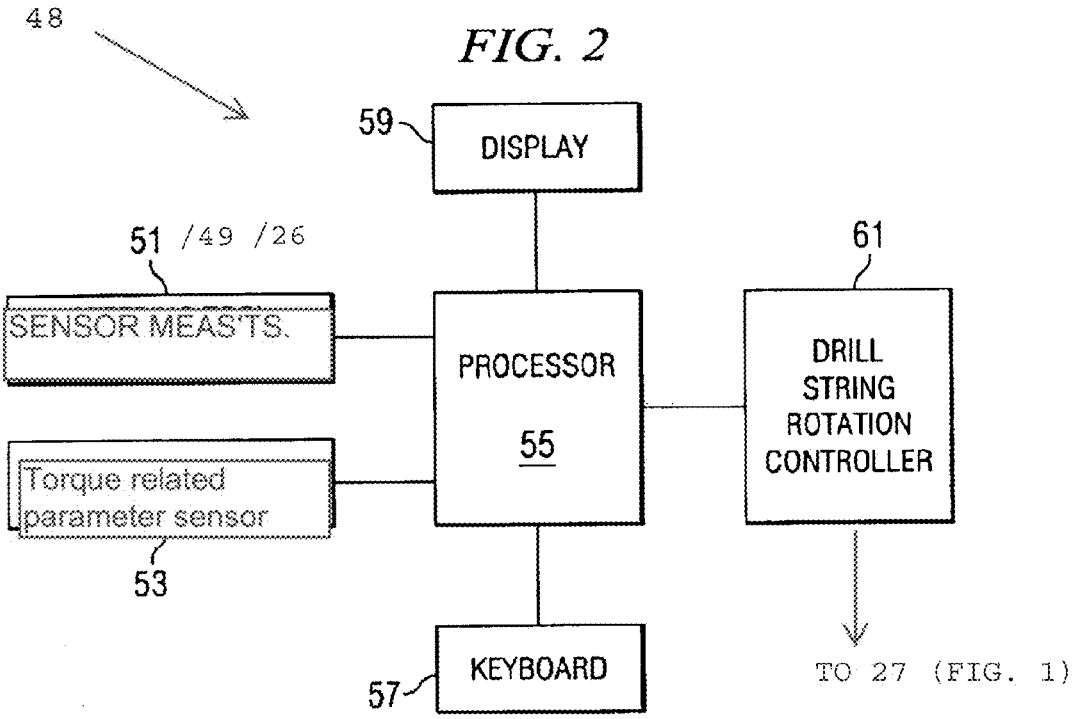
FIG. 2 is a block diagram of an example pipe rotation control system.

FIG. 2 shows a block diagram of an example of the automatic drill string rotation controller 48. The automatic drill string rotation controller 48 may include a drill string rotation control system. Such system may include a torque related parameter sensor 53. The torque related parameter sensor 53 may provide a measure of the torque applied to the drill string (31 in FIG. 1) at the surface by the top drive or kelly. The torque related parameter sensor 53 may implemented as a strain gage in the instrumented top sub (29 in FIG. 1) if it is configured to measure torque. The torque related parameter sensor 53 may also be implemented, for example and without limitation, as a current measurement device for an electric rotary table or top drive motor, as a pressure sensor for an hydraulically operated top drive, or as an angle of rotation sensor for measuring drill string rotation. In principle, the torque related parameter sensor 53 may be any sensor that measures a parameter that can be directly or indirectly related to the amount of torque applied to the drill string.

The output of the torque related parameter sensor 53 may be received as input to a processor 55. In some examples, output of the pressure sensor 49 and/or one or more sensors of the MWD/LWD system 51 may also be provided as input to the processor 55. The processor 55 may be any programmable general purpose processor such as a programmable logic controller (PLC) or may be one or more general purpose programmable computers. The processor 55 may receive user input from user input devices, such as a keyboard 57. Other user input devices such as touch screens, keypads, and the like may also be used. The processor 55 may also provide visual output to a display 59. The processor 55 may also provide output to a drill string rotation controller 61 that operates the top drive (27 in FIG. 1) or rotary table (FIG. 3) to rotate the drill string as will be further explained below.

The drill string rotation controller 61 may be implemented, for example, as a servo panel (not shown separately) that attaches to a manual control panel for the top drive. One such servo panel is provided with a service sold under the service mark SLIDER, which is a service mark of Schlumberger Technology Corporation, Sugar Land, Tex. The drill string rotation controller 61 may also be implemented as direct control to the top drive motor power input (e.g., as electric current controls or variable orifice hydraulic valves). The type of drill string rotation controller is not a limit on the scope of the present disclosure.

According to one example, the processor 55 operates the drill string rotation controller 61 to cause the top drive (27 in FIG. 1) or kelly (4 in FIG. 2) to rotate the drill string (31 in FIG. 1) in a first direction, while measuring the drill string torque related parameter using the torque related parameter sensor 53. The rotation controller 61 continues to cause the top drive or kelly to rotate the drill string (31 in FIG. 1) in the first direction until a first selected value of the torque related parameter is reached. When the processor 55 registers the torque related parameter magnitude measured by torque related parameter sensor 53 as having reached the first selected value, the processor 55 actuates drill string rotation controller 61 to cause the top drive or kelly to reverse the direction of rotation of the drill string (31 in FIG. 1) until a second selected torque related parameter value is reached. As drilling progresses, the processor 55 continues to accept as input measurements from the torque related parameter sensor 53 and actuates the rotation controller 61 to cause rotation of drill string (31 in FIG. 1) back and forth between the first selected parameter value and the second selected parameter value. The back and forth rotation may reduce or eliminate stick/slip friction between the drill string (31 in FIG. 1) and the wellbore (33 in FIG. 1), thereby making it easier for the drilling rig operator to control, for example, the axial force exerted on the drill bit (2 in FIG. 1), called "weight on bit."

Figure 4:
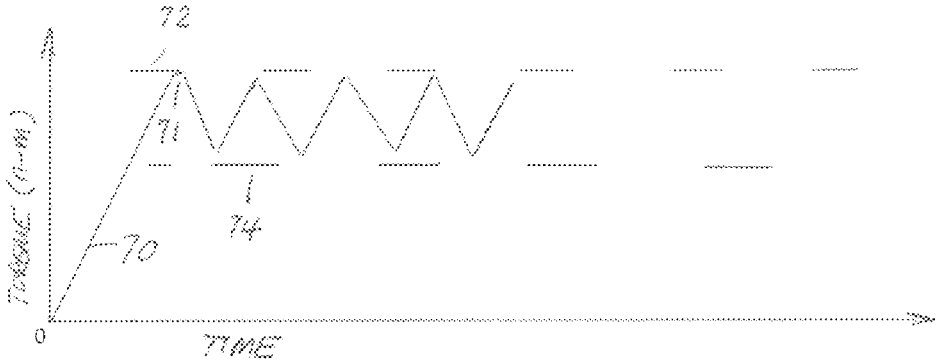
FIG. 4 shows a graph of torque applied to the drill string in accordance with an example implantation.

FIG. 4 graphically illustrates torque applied to the drill string in order to explain example techniques for selecting the first and second selected torque related parameter values. The graph in FIG. 4 is scaled in torque to help explain the principle of the example method, however, as explained above, any torque related parameter may be used. Initially, as shown at time=0, the drill string (31 in FIG. 1) may have zero torque applied by the top drive or kelly. As the top drive or kelly rotates the drill string in the first direction, as shown by curve 70, the applied torque increases with respect to amount of rotation, generally until the torque exceeds the frictional force between the drill string and the wellbore wall. At such point, shown at 71, the torque stops increasing, because the entire drill string will begin rotating. It may be undesirable for purposes of reducing stick-slip motion of the drill string to rotate the entire drill string during drilling. Therefore, such torque point 71 may be selected as the first torque related parameter value, or may be set as an upper limit to the first torque related parameter value. When the first torque related parameter value is reached, the drill string may be rotated in the second direction so as to reduce the torque applied to the drill string. Reduction in torque may continue until the second torque related parameter value is reached. By way of example, and without limitation, the first direction of drill string rotation may be the same as the direction of "make up" (tightening) the threads (not shown) used to join the segments (35 in FIG. 1) of the drill string. After the second torque related parameter value is reached, rotation of the drill string may be reversed until the first torque related parameter value is reached once again. The foregoing drill string rotation in the first and second directions may be repeated so that the applied torque or torque related parameter varies between the first value, shown by dashed line 72 and the second value, shown by dashed line 74. The second torque related parameter value is lower than the first torque related parameter value, but the torque applied to the drill string remains in the same direction. The drill string may be advanced axially along the wellbore by suitable operation of the rig components that suspend the top drive (or kelly, if used), as explained with reference to FIG. 1.

Figure 5:
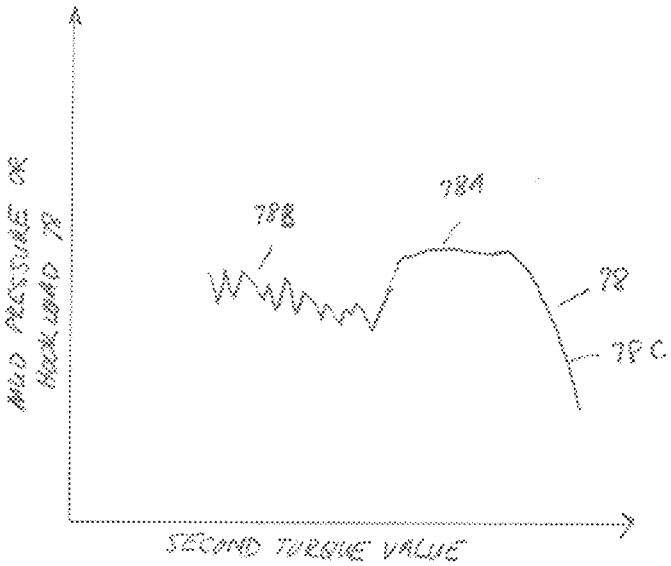
FIG. 5 shows a graph of hookload or mud pressure with respect to a second torque value.

The second torque related parameter value may be empirically determined. One possible empirical criterion is that torque reduction on the drill string by rotation in the second direction may extend to a selected position along the drill string in the wellbore. Such position may be determined, for example, by calculation using torque and drag calculation programs or algorithms known in the art. As another example, and referring to FIG. 5, the second torque value may be empirically determined so as to reduce stick-slip or other destructive motion of the drill string, where such reduction is shown by a measured parameter, and/or rate of advance of the drill string ("rate of penetration") is optimized. "Optimized" as used in the present context may mean, for example, a maximum value consistent with reduced or eliminated destructive drill string motion and associated shock and vibration. The graph in FIG. 5 shows an example, at curve 78, of correspondence between hookload (which corresponds to axial force on the drill bit) or the mud pressure (as measured by the pressure sensor 49 in FIG. 1). When the second torque related parameter value is such that stick slip motion is reduced, the hookload may be relatively constant, as shown at 78A. If the second torque related parameter value is too high, as shown at 78C, the drill string may not move axially, indicating sticking, whereupon the hookload may drop as the drill bit is no longer able to drill the formations. If the second torque related parameter value is too low, there may be variations in the hookload, as shown at 78B, indicating undesirable or destructive motion of the drill string. If the motor (41 in FIG. 1) is operated by the drilling fluid, the measured drilling fluid pressure may exhibit the same characteristics with respect to the second torque related parameter value as does the hookload. Other examples of measurements that may be used to select the second torque related parameter value may include, without limitation, acceleration measurements from the accelerometer or similar sensor (51A in FIG. 3). Whether the indicated amount of variation in the measured parameter is excessive may be determined, for example, by setting an upper limit of root mean square (RMS) variation or other suitable statistical measure of variability of the measured parameter associated with destructive motion of the drill string. The second selected torque related parameter value may be increased, for example, until the variation falls below a selected threshold. The foregoing examples of selecting the first and second selected torque related parameter values may be performed, for example, manually by the system operator observing the torque related parameter and the one or more measured parameters on the display (59 in FIG. 2), or may be computed automatically by suitable programming implemented on the processor (55 in FIG. 2).

A method for drilling a wellbore according to the various examples described herein may reduce failure of drill string components and drill string instrumentation, may increase the life of drilling motors, may increase control over wellbore trajectory while drilling with RSS systems, and may increase overall drilling efficiency by optimizing rate of penetration of the formations by the drill bit. The present method may also reduce the amount of drill string rotation and therefore reduce drill string fatigue (e.g. pipe, tool joint failures, and BHA component failures) and reduce wear issues related to pipe rotation (e.g. casing wear, key seating, subsea well head wear for offshore applications).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for drilling a wellbore, comprising:

operating at least one motor coupled within a drill string to turn a drill bit at an end thereof;

operating an automatic drill string rotation controller to cause rotation of the drill string in a first direction until a measured parameter related to torque on the drill string reaches a first selected value;

operating the automatic drill string rotation controller to cause rotation of the drill string in a second direction until the measured parameter related to torque is reduced to a second selected value, wherein the second selected value is in a same rotational direction as the first selected value; and axially advancing the drill string to cause the drill bit to extend the wellbore.

2. The method of claim 1 further comprising repeating the rotating the drill string in the first direction, rotating the drill string in the second direction and axially advancing the drill string.

3. The method of claim 1 wherein the first selected value is determined by initiating rotation of the drill string in the first direction until the measured torque related parameter substantially stops increasing.

4. The method of claim 1 wherein the second selected value is determined by rotating the drill string in the second direction and determining a torque related parameter value at which a rate of penetration of the drill string is optimized.

5. The method of claim 4 wherein the optimized rate of penetration is determined by measuring at least one parameter related to destructive motion of the drill string, and determining the torque related parameter value when the at least one parameter related to destructive motion indicates the destructive motion has been substantially eliminated.

6. The method of claim 5 wherein the at least one parameter related to destructive motion comprises hookload.

7. The method of claim 5 wherein the at least one parameter related to destructive motion comprises drilling fluid pressure when the motor is operated by flow thereof.

8. The method of claim 5 wherein the at least one parameter related to destructive motion comprises acceleration of a component of the drill string.

9. The method of claim 5 wherein indication of reduction in destructive motion comprises determining when variation in the measured parameter related to destructive motion falls below a selected threshold.

10. The method of claim 1 further comprising operating a rotary steerable directional drilling system coupled in the drill string to cause the wellbore to follow a selected trajectory.

11. A method for drilling a wellbore, comprising:

operating at least one motor coupled within a drill string to turn a drill bit at an end thereof;

automatically rotating the drill string in a first direction until a measured parameter related to torque applied to the drill string reaches a first selected value;

automatically rotating the drill string in a second direction until the measured parameter is reduced to a second selected value, wherein the second selected value is in a same rotational direction as the first selected value;

axially advancing the drill string to cause the drill bit to extend the wellbore; and operating a rotary steerable directional drilling system coupled in the drill string to cause the wellbore to follow a selected trajectory.

12. The method of claim 11 further comprising repeating the rotating the drill string in the first direction, rotating the drill string in the second direction and axially advancing the drill string.

13. The method of claim 11 wherein the first selected value is determined by initiating rotation of the drill string in the first direction until the measured torque substantially stops increasing.

14. The method of claim 11 wherein the second selected value is determined by rotating the drill string in the second direction and determining a torque at which a rate of penetration of the drill string is optimized.

15. The method of claim 14 wherein the optimized rate of penetration is determined by measuring at least one parameter related to destructive motion of the drill string, and determining the torque related parameter when the at least one parameter related to destructive motion indicates the destructive motion has been substantially eliminated.

16. The method of claim 15 wherein the at least one parameter related to destructive motion comprises hookload.

17. The method of claim 15 wherein the at least one parameter related to destructive motion comprises drilling fluid pressure when the motor is operated by flow thereof.

18. The method of claim 15 wherein the at least one parameter related to destructive motion comprises acceleration of a component of the drill string.

19. The method of claim 15 wherein indication of reduction in destructive motion comprises determining when variation in the measured parameter related to destructive motion falls below a selected threshold.

20. A method for drilling a wellbore, comprising:

operating at least one motor coupled within a drill string to turn a drill bit at an end thereof;

automatically rotating the drill string in a first direction until a measured torque on the drill string reaches a first selected value;

automatically rotating the drill string in a second direction until the measured torque is reduced to a second selected value, wherein the second selected value is in a same rotational direction as the first selected value;

axially advancing the drill string to cause the drill bit to extend the wellbore; and operating a rotary steerable directional drilling system coupled in the drill string to cause the wellbore to follow a selected trajectory.

* * * * *